US008871037B2

(12) United States Patent
Feng et al.

(10) Patent No.: US 8,871,037 B2
(45) **Date of Patent: *Oct. 28, 2014**

(54) METHOD FOR CARRYING OUT DIFFUSION TREATMENT ON COATING OF ENGINEERING PARTS RESISTANT TO MARINE CLIMATE

(75) Inventors: Lixin Feng, Jiangsu (CN); Minyan Zhang, Jiangsu (CN); Qiang Miao, Jiangsu (CN)

(73) Assignee: Jiangsu Linlong New Materials Co., Ltd., Rongdong Village, Yuqi Town, Huishan, Wuxi, Jiangsu (CN)

( * ) Notice: Subject to any disclaimer, the term of this patent is extended or adjusted under 35 U.S.C. 154(b) by 337 days.

This patent is subject to a terminal disclaimer.

(21) Appl. No.: 13/127,222

(22) PCT Filed: Mar. 31, 2010

(86) PCT No.: PCT/CN2010/071484

§ 371 (c)(1),
(2), (4) Date: May 2, 2011

(87) PCT Pub. No.: WO2011/079555

PCT Pub. Date: Jul. 7, 2011

(65) Prior Publication Data

US 2012/0263972 A1 Oct. 18, 2012

(30) Foreign Application Priority Data

Dec. 28, 2009 (CN) ..... 2009 1 0262715

(51) Int. Cl.
*C23C 22/72* (2006.01)

(52) U.S. Cl.
USPC ..... 148/242; 427/320; 427/321; 427/327; 427/328; 427/433

(58) Field of Classification Search
USPC ..... 148/242; 427/320, 321, 327, 328, 433
See application file for complete search history.

(56) References Cited

U.S. PATENT DOCUMENTS 3,000,755 A * 9/1961 Hanink et al. ..... 148/535
3,639,107 A * 2/1972 Thompson ..... 428/653

FOREIGN PATENT DOCUMENTS

JP 07-076762 * 3/1995 ..... C23C 2/32
WO PCT/CN2010/071484 10/2010

* cited by examiner

*Primary Examiner* — Lois Zheng
(74) *Attorney, Agent, or Firm* — Tianhua Gu; Global IP Services

(57) ABSTRACT

The present invention relates to a method for diffusion treatment of a coating on an engineering part resistant to marine climate, comprising: Step 1. pretreating the part; Step 2. preheating the part in a protective atmosphere furnace; Step 3. immersing the pre-heated part in a plating solution in a way that the part is rotated in the submerging process; Step 4. carrying out diffusion treatment, i.e., placing the immersion-plated part into a vacuum furnace, maintaining at 800 to 950° C. for 1 to 3 hours, and then cooling it down prior to discharge, such that atoms at an interface are diffused to form a diffusion layer on a substrate, achieving metallurgical bonding between the coating and the substrate. Treatment by the method of the present invention enables the part to have full resistance to corrosion and scouring erosion under marine climate.

7 Claims, No Drawings

METHOD FOR CARRYING OUT DIFFUSION TREATMENT ON COATING OF ENGINEERING PARTS RESISTANT TO MARINE CLIMATE

CROSS REFERENCE TO RELATED PATENT APPLICATION

The present application is the US national stage of PCT/2010/071484 filed on Mar. 31, 2010, which claims the priority of the Chinese patent application No. 200910262715.3 filed on Dec. 28, 2009, which application is incorporated herein by reference.

BACKGROUND OF THE INVENTION

1. Field of Invention

The present invention relates to a method for diffusion treatment of a coating on an engineering part resistant to marine climate.

2. Related Art

With the rapid growth of science and technology, more and more engineering equipment is applied in offshore water and ocean, but its service environment is generally higher than level C5 according to ISO 9225 environmental assessment standard and belongs to extremely harsh environment with rainy, high temperature, salt misty and strong wind. Comprehensive actions of strong atmospheric corrosion, electrochemical corrosion and current scour corrosion on exposed parts cause service lives of various steel structures to be far shorter than that in the common inland outdoor environment. For example, wind power generating device, one of typical engineering devices, services under marine climate, and because wind turbines utilize wind energy to generate electricity, and there is rich wind resources at coast lines and offshore waters, most wind power plants are located at coastal or offshore waters. Wind turbines serviced in marine climate with common protective measures are usually seriously corroded within only a couple of months because the external members, such as engine rooms, engine covers, tower structures, etc., are directly exposed in extremely corrosive atmosphere, which brings about huge losses. According to statistics, the loss caused by marine corrosion accounts for one third of total loss, and the loss of accidents caused by marine corrosion is uncountable. For instance, in 1969 a Japanese 50 thousand ton special ore transport vessel suddenly sank due to corrosion brittle damage. Therefore, it is strategically significant to enhance corrosion control and reduce the loss of metal material to prevent equipment from suffering premature or accidental damage in marine environment.

The rapid growth of modern surface engineering technology provides diverse solutions such as electroplating, chemical plating, thermal spraying, vapor deposition, etc. for corrosion protection on surface of steel. But the above solutions have certain problems, in which the common problems are complex processes and high production cost, and more seriously, a coating obtained by the above methods easily flakes off resulting in failure under the effect of stress and environment. Therefore, it has been an urgent need of current industry development to develop an effective novel process for improving combination strength between a coating and a substrate.

SUMMARY OF THE INVENTION

Against the problems in the prior art, the present invention provides a method for diffusion treatment of a coating on an engineering part resistant to marine climate, thoroughly solving the problems in the prior art.

The method for diffusion treatment of the coating on the engineering part resistant to marine climate provided by the present invention comprises:

Step 1: pretreating the part;

Step 2: preheating the part in a protective atmosphere furnace;

Step 3: immersing the preheated part in a plating solution in a way that the part is rotated in the submerging process; and Step 4: carrying out diffusion treatment, i.e., placing the immersion-plated part into a vacuum furnace, maintaining at 800-950° C. for 1-3 hours, and then cooling it down prior to discharge, such that atoms at an interface are diffused to form a diffusion layer on a substrate, achieving metallurgical bonding between the coating and the substrate.

Preferably, the pretreatment of the part in Step 1 includes degreasing, derusting and etching treatment.

More preferably, in the etching treatment, the degreased and derusted part is placed into a mixed solution of hydrochloric acid and hydrofluoric acid for etching 1-3 minutes at room temperature, wherein the mixed solution of hydrochloric acid and hydrofluoric acid has 94-96% by volume of hydrochloric acid and 4-6% by volume of hydrofluoric acid.

Preferably, in Step 2, the part is preheated in the protective atmosphere furnace for 10-20 minutes at the temperature of 500-650° C.

Preferably, in Step 3, the preheated part is placed in the plating solution for 1-5 minutes, wherein the plating solution mainly includes Zn, Al, Si, Re, microalloy elements and the oxide nano-particle reinforcing agent; the oxide nano-particle reinforcing agent is selected from one or two of $TiO_2$ and $CeO_2$; the microalloy elements are selected from one or more of Mg, Ti and Ni, and the percents by mass of the components in the plating solution are as follows: Zn: 35-58%, Si: 0.3-4.0%, Re: 0.02-1.0%, total of the oxide nano-particle reinforcing agent: 0.01-1.0%, total of the microalloy elements: 0.01-6.0%, and Al: the balance.

More preferably, the oxide nano-particle reinforcing agent has an average particle size of 15-60 nm.

More preferably, the percents by mass of the components specifically added into the microalloy elements are as follows: Mg: 0.1-5.0%, Ti: 0.01-0.5%, and Ni: 0.1-3.0%.

Preferably, in Step 4, the atoms at the interface are diffused to form the diffusion layer with the thickness of 10-30 μm on the substrate.

In another aspect, the present invention further provides a part having the marine climate-resistant coating treated by diffusion, wherein the coating on the surface of the part has the thickness of 200-300 μm, and the coating also comprises the diffusion layer formed on a substrate through diffusion of atoms at an interface, for metallurgical bonding between the coating and the substrate, and the diffusion layer has the thickness of 10-30 μm.

Preferably, the diffusion layer is formed by:

Step 1: pretreating the part;

Step 2: preheating the part in the protective atmosphere furnace;

Step 3: immersing the preheated part in the plating solution in a way that the part is rotated in the submerging process; and Step 4: carrying out diffusion treatment, i.e., placing the immersion-plated part in the vacuum furnace, maintaining it at 800-950° C. for 1-3 hours, and then cooling it down prior to discharge, such that atoms at an interface are diffused to form the diffusion layer on a substrate, achieving metallurgical bonding between the coating and the substrate.

Before immersion plating, the part to be plated by immersion are placed into the protective atmosphere furnace for preheating for a given period, to reduce mechanical performance mismatch between the coating and the substrate, such that the coating cannot flake off even under contact fretting load.

On the other hand, the coating formed by the plating solution of the present invention has significantly improved resistance to atmosphere corrosion, electrochemical corrosion and air stream scouring erosion as well as remarkably enhanced strength, hardness and scouring resistance.

Furthermore, in the present invention, a step of diffusion treatment is additionally provided after immersion plating, such that the coating is firmly bonded with the substrate and cannot easily flake off even under the co-effect of stress and environment, thereby having favorable protecting effect and being totally suitable for extremely harsh environments such as marine environment, etc.

In summary, compared with the prior art, the present invention has simplified production process, low cost and wide adjustable range of thickness of the coating; the coating has better corrosion and wear resistances and firm bonding with the substrate, does not easily flake off and is suitable for treatment of the part having different sizes. The method has simple process and low production cost and is suitable for the part having different sizes and in any shape. Treatment by the present invention enables the part to have full resistance to corrosion and scouring erosion under marine climate.

DETAILED DESCRIPTION OF THE INVENTION

The present invention provides a method for diffusion treatment of a coating on an engineering part resistant to marine climate, comprising:

Step 1: pretreating the part;

Step 2: preheating the part in a protective atmosphere furnace;

Step 3: immersing the preheated part in a plating solution in a way that the part is rotated in the submerging process; and Step 4: carrying out diffusion treatment, i.e., placing the immersion-plated part into a vacuum furnace, maintaining at 800-950° C. for 1-3 hours, and then cooling it down prior to discharge, such that atoms at an interface are diffused to form the diffusion layer on a substrate, achieving metallurgical bonding between the coating and the substrate.

In the following, given are some preferable embodiments of diffusion treatment method according to the present invention for preparing the anti-corrosion coating on the surface of steel structure part resistant to marine climate. But it is noted that, the conditions given in the following embodiments are not described as essential technical features, and those skilled in the art can carry out reasonable generalization and deduction on the basis of values listed in the embodiments.

Embodiment 1

(1) The part was cleaned and degreased, then derusted through acid cleaning and rinsed by deionized water.

(2) The degreased and derusted part was etched in the mixed solution of 94% by volume of hydrochloric acid and 6% by volume of hydrofluoric acid for 1 minute at room temperature and then were rinsed by deionized water.

(3) The part after treatment in (1) and (2) was placed into the protective atmosphere furnace and preheated for 20 minutes at 500° C.

(4) In the protective atmosphere furnace, the preheated steel part was immersed in the plating solution for 1 minute in a way that the part was rotated in the submerging process.

(5) The immersion-plated part was placed in the vacuum furnace for 3 hours at 800° C. and then cooled down prior to discharge, such that the diffusion layer was formed under the coating; resulting in formation of a protective plating diffusion composite layer on the surface of the part.

Embodiment 2

(1) The part was cleaned and degreased, then derusted through acid cleaning and were rinsed by deionized water.

(2) The degreased and derusted part was etched in the mixed solution of 95% by volume of hydrochloric acid and 5% by volume of hydrofluoric acid for 2 minute at room temperature and then were rinsed by deionized water.

(3) The part after treatment in (1) and (2) was placed into the protective atmosphere furnace and preheated for 15 minutes at 600° C.

(4) In the protective atmosphere furnace, the preheated steel part was immersed in the plating solution for 3 minute in a way that the part was rotated in the submerging process.

(5) The immersion-plated part was placed in the vacuum furnace for 2 hours at 880° C. and then cooled out prior to discharge, such that the diffusion layer was formed under the coating; resulting in formation of the protective plating diffusion composite layer on the surface of the part.

Embodiment 3

(1) The part was cleaned and degreased, then derusted through acid cleaning and were rinsed by deionized water.

(2) The degreased and derusted part was etched in the mixed solution of 96% by volume of hydrochloric acid and 4% by volume of hydrofluoric acid for 3 minutes at room temperature and then were rinsed by deionized water.

(3) The part after treatment in (1) and (2) was placed into the protective atmosphere furnace and preheated for 10 minutes at 650° C.

(4) In the protective atmosphere furnace, the preheated steel part was immersed in the plating solution for 5 minute in a way that the part was rotated in the submerging process.

(5) The immersion-plated part was placed in the vacuum furnace for 1 hour at 950° C. and then cooled down prior to discharge, such that the diffusion layer was formed under the coating, resulting in formation of the protective plating diffusion composite layer on the surface of the part.

In the Embodiments 1-3, the plating solution had the following components and contents shown in table 1. It was particularly noted that table 1 merely showed the preferable embodiments of the plating solutions of the present invention, although microalloy elements in table 1 simultaneously include Mg, Ti and Ni, these was not described as essential technical features, and the microalloy elements of the present invention can be selected form any one, two or three of Mg, Ti and Ni, and similarly, although the oxide nano-particle reinforcing agent listed in table 1 was $TiO_2$, the oxide nano-particle reinforcing agent of the present invention can be $CeO_2$ or both.

TABLE 1

| Percentage (%) by mass of the components based on the total weight | | | | | | | | |
|---|---|---|---|---|---|---|---|---|
| | Element | | | | | | | |
| No. | Al | Zn | Si | Re | Mg | Ti | Ni | $TiO_2$ |
| 1 | balance | 35 | 4.0 | 1.0 | 0.1 | 0.5 | 0.1 | 1.0 |
| 2 | balance | 36 | 3.9 | 0.9 | 0.3 | 0.48 | 0.2 | 0.9 |
| 3 | balance | 37 | 3.8 | 0.8 | 0.5 | 0.45 | 0.3 | 0.8 |
| 4 | balance | 39 | 3.6 | 0.6 | 0.8 | 0.40 | 0.5 | 0.6 |
| 5 | balance | 41 | 3.2 | 0.4 | 1.0 | 0.35 | 0.7 | 0.4 |
| 6 | balance | 43 | 2.8 | 0.3 | 1.3 | 0.30 | 1.0 | 0.3 |
| 7 | balance | 45 | 2.5 | 0.2 | 1.8 | 0.25 | 1.3 | 0.2 |
| 8 | balance | 47 | 2.2 | 0.15 | 2.2 | 0.20 | 1.5 | 0.15 |
| 9 | balance | 49 | 1.8 | 0.13 | 2.6 | 0.15 | 1.8 | 0.13 |
| 10 | balance | 51 | 1.5 | 0.11 | 3.0 | 0.1 | 2.0 | 0.11 |
| 11 | balance | 53 | 1.0 | 0.09 | 3.5 | 0.08 | 2.4 | 0.09 |
| 12 | balance | 55 | 0.8 | 0.07 | 4.0 | 0.05 | 2.6 | 0.07 |
| 13 | balance | 56 | 0.5 | 0.05 | 4.5 | 0.03 | 2.8 | 0.05 |
| 14 | balance | 57 | 0.4 | 0.03 | 4.8 | 0.02 | 2.9 | 0.03 |
| 15 | balance | 58 | 0.3 | 0.02 | 5.0 | 0.01 | 3.0 | 0.01 |

Preferably, the oxide nano-particle reinforcing agent has the average particle size of 15-60 nm.

Preferably, the percents by mass of the components specifically added into the microalloy elements are as follows: Mg: 0.1-5.0%, Ti: 0.01-0.5%, and Ni: 0.1-3.0%.

In another aspect, the present invention further provides a part having a marine climate-resistant coating treated by diffusion, wherein the coating on the surface of the part has the thickness of 200-300 μm, and the coating also comprises the diffusion layer formed on the substrate through diffusion of atoms at an interface, for metallurgical bonding between the coating and the substrate, and the diffusion layer has the thickness 10-30 μm. The preferable embodiments of the coating treated by diffusion according to the present invention are given in table 2 below:

TABLE 2

| Thickness Unit (μm) | | | | |
|---|---|---|---|---|
| No. | Thickness of the coating | Thickness of the diffusion layer | Bonding force of the coating | Corrosion resistance |
| 1 | 200 | 10 | Level 1 | Better |
| 2 | 210 | 11 | Level 1 | Better |
| 3 | 220 | 13 | Level 1 | Excellent |
| 4 | 235 | 16 | Level 1 | Excellent |
| 5 | 250 | 19 | Level 1 | Excellent |
| 6 | 260 | 21 | Level 1 | Excellent |
| 7 | 270 | 25 | Level 1 | Excellent |
| 8 | 290 | 28 | Level 2 | Excellent |
| 9 | 300 | 30 | Level 2 | Excellent |

Note:
the method for testing bonding force of the coating was carried out with reference to GB1720-79

From above, although some preferable embodiments are given in the above, the concept of the present invention is not limited to this, and non-essential modifications of the present invention on this basis are intended to fall within the scope of the present invention.

What is claimed is:

1. A method of carrying out a diffusion treatment for a coating of a steel engineering part to increase resistance to marine climate, comprising:

first step, pre-treating the part;

second step, preheating the part in a furnace in a protective atmosphere;

third step, submerging and turning the preheated part in a plating solution for 1-5 minutes, wherein said plating solution comprises in mass percentages:

Zn: 35-58%;

Si: 0.3-4.0%;

Re: 0.02-1.0%;

microalloy elements: 0.01-6.0%;

nanometer oxide particle reinforcing agents: 0.01-1.0%; and

Al: reminder;

wherein said microalloy elements are selected from the group consisting of Mg, Ti, Ni, and a combination thereof;

wherein said nanometer oxide particle reinforcing agents are selected from the group consisting of $TiO_2$, $CeO_2$, and a combination thereof; and fourth step, subjecting the plated part to a diffusion treatment in a vacuum furnace at a temperature of 800-950° C. for 1-3 hours, then reducing the temperature gradually, followed by taking out the diffusion treated part, thereby forming a diffusion layer on a substrate of the part, through diffusion of atoms at an interface to achieve a metallurgical combination between the coating and the substrate.

2. The method according to claim 1, wherein the pretreatment of the part in the first step includes degreasing, derusting and etching.

3. The method according to claim 2, wherein said etching treatment comprising, after said degreasing and said derusting, putting the part into an etching solution comprising 94-96 vol % of hydrochloric acid and 4-6 vol % of hydrofluoric acid for 1-3 minutes at room temperature.

4. The method according to claim 1, wherein in the second step, said part is preheated for 10-20 minutes at a temperature of 500-650° C.

5. The method according to claim 1, wherein said microalloy elements comprises, in mass percentages, Mg: 0.1-5.0%, Ti: 0.01-0.5%, and Ni: 0.1-3.0%.

6. The method according to claim 1, wherein in the fourth step, said diffusion layer has a thickness of 10-30 μm.

7. The method according to claim 1, wherein said coating has a thickness of 200-300 μm, wherein said coating contains a diffusion layer formed on a substrate of the part through diffusion of atoms at the interface which leads to the metallurgical combination of the coating and the substrate, and said diffusion layer has a thickness of 10-30 μm.

* * * * *